US009593895B2

(12) United States Patent
Kim

(10) Patent No.: US 9,593,895 B2
(45) Date of Patent: Mar. 14, 2017

(54) CLEANING BRUSH DEVICE FOR CONDENSER

(71) Applicant: Brian S. Kim, Rancho Palos Verdes, CA (US)

(72) Inventor: Brian S. Kim, Rancho Palos Verdes, CA (US)

(73) Assignee: KIM FAMILY TRUST, Rancho Palos Verdes, CA (US)

( * ) Notice: Subject to any disclaimer, the term of this patent is extended or adjusted under 35 U.S.C. 154(b) by 319 days.

(21) Appl. No.: 14/530,579

(22) Filed: Oct. 31, 2014

(65) Prior Publication Data

US 2016/0123684 A1 May 5, 2016

(51) Int. Cl.

| | |
|---|---|
| ***F28D 17/00*** | (2006.01) |
| ***F28G 1/12*** | (2006.01) |
| ***F28G 3/04*** | (2006.01) |
| ***A46B 13/02*** | (2006.01) |
| ***A46B 13/00*** | (2006.01) |

(52) U.S. Cl.

CPC ..... *F28G 3/04* (2013.01); *A46B 13/001* (2013.01); *A46B 13/02* (2013.01); *A46B 13/026* (2013.01); *A46B 2200/30* (2013.01); *A46B 2200/3013* (2013.01); *A46B 2200/3073* (2013.01)

(58) Field of Classification Search

CPC ..... F28G 3/04; A46B 13/026; A46B 13/02; A46B 2200/3013; A46B 2200/30; A46B 2200/3073

USPC ..... 165/5, 95, 185

See application file for complete search history.

(56) References Cited

U.S. PATENT DOCUMENTS

| | | | | |
|---|---|---|---|---|
| 1,985,156 A * | 12/1934 | Fieldhouse | ..... | F28G 3/10 15/104.04 |
| 4,660,627 A * | 4/1987 | Deck | ..... | F28G 3/00 165/84 |
| 5,211,028 A * | 5/1993 | Remo | ..... | F28G 1/02 165/94 |
| 6,041,612 A * | 3/2000 | Stringer | ..... | F28G 1/02 165/95 |

(Continued)

FOREIGN PATENT DOCUMENTS

| | | | | |
|---|---|---|---|---|
| DE | 3120376 A1 * | 12/1982 | ..... | F28G 3/04 |
| IL | WO 2011135568 A2 * | 11/2011 | ..... | B08B 1/008 |

(Continued)

*Primary Examiner* — Len Tran

*Assistant Examiner* — Claire Rojohn, III

(74) *Attorney, Agent, or Firm* — John K. Park; Park Law Firm

(57) ABSTRACT

A dust cleaning device for condenser of cooler is provided. Since the dust from outside is attached to the condenser due to ventilation and they become one of reasons for compressor failure, the device is configured to clean the heat exchange fin of the condenser periodically, in which a wire winch and a cleaning brush is connected to a driving axle of a driving motor such that the cleaning brush performs up-and-down motion and rotation with a power of the driving motor and cleans the heat exchange fin. In other structure, pinion and rack can be connected to the driving axle to perform the up-and-down motion. The cleaning brush is made of textile or unwoven fabric. Furthermore, the cleaning brush further includes a plurality of long brush portions protruding above the cleaning brush.

14 Claims, 12 Drawing Sheets

(56) References Cited

U.S. PATENT DOCUMENTS

| | | | | |
|---|---|---|---|---|
| 7,624,470 | B2 * | 12/2009 | Heyman | F25B 47/00 15/301 |
| 8,245,347 | B2 * | 8/2012 | Goldberg | D06F 58/22 15/302 |
| 8,266,815 | B2 * | 9/2012 | Goldberg | D06F 58/20 15/104.04 |
| 2007/0062211 | A1 * | 3/2007 | Anderson | F25B 47/00 62/303 |
| 2011/0296641 | A1 * | 12/2011 | Kim | F28G 1/02 15/160 |

FOREIGN PATENT DOCUMENTS

| | | | | |
|---|---|---|---|---|
| IT | EP 1486264 | A1 * | 12/2004 | B08B 1/008 |
| KR | 20110018190 | A * | 2/2011 | F28G 3/04 |
| SE | WO 2011117348 | A2 * | 9/2011 | A46B 11/001 |

* cited by examiner

CLEANING BRUSH DEVICE FOR CONDENSER

RELATED APPLICATION

This application is a continuation-in-part application of the U.S. patent application Ser. No. 13/095,739 for "CLEANING BRUSH DEVICE FOR CONDENSER" filed on Apr. 27, 2011.

BACKGROUND OF THE INVENTION

The present invention relates to a dust cleaning device, which can cleanse dust and other undesirables attached to the heat exchange fin due to wind blowing for increasing efficiency of the condenser performing liquifying of refrigerant in showcase, freezer, refrigerator, etc.

Showcase, freezer, refrigerator, etc. are devices for storing food at a low temperature so as to prevent the food from decaying, use the heat of vaporization of refrigerant such as Freon, and perform a heat exchange in the condenser to obtain the heat of vaporization. Here, in order to increase the efficiency of the heat exchange, a twisted condensing tube and a plurality of heat exchange fins formed on the condensing tube are blown with by cold air by a ventilating fan.

The condenser usually collects a lot of debris and small stuffs such as dust from outside due to the ventilation, which is for increasing efficiency of condenser, and such dusts causes the performance of heat exchange decreased and the compressor break down.

In order to improve such problems, a device of removing bad smell from air-conditioner was suggested in the Korean Patent Application 10-0218460, which forms a spraying tube connected to a medicine container on a top portion of the vaporizer and having a nozzle, and cleansing was performed through killing germs by a medicine mixed with cleaning water and cleaning by spraying of the cleaning water, by spraying the cleaning water in the medicine container by closing and opening valve by control signals.

However, the spraying of cleaning water had problems that the spraying power of the sprayer is weak, and it could not spray the cleaning water in a spraying power and into between the heat exchange fins, which can remove dust stuck strongly or between the narrowly-spaced heat exchange fins.

Additionally, an air-filter automatic cleaning device in another Korean Patent Application 10-1997-0047263 had a filter wired in an endless track form connected to a cleaning brush driven by a driving motor engage with a condenser, such that the filter rotated and cleaned dust off the surface of the condenser and increased the efficiency by spraying cleaning water from the brush, facilitating the cleaning.

The filter in such a structure performed just cleaning of the surface of condenser through friction, but could not clean and remove dust stuck between the heat exchange fins of the condenser.

Also, since the filter of endless track type was prone to be worn out easily and cut out frequently, it could not be used for an extended time period, the filter formed with textile fabric or unwoven fabric was always present together with moisture due to the cleaning water, such that it provided an environment of bad smells and dirtiness due to inhabitation and multiplication of bacterial germs enabled by the moisture.

Accordingly, a need for a cleaning device for condenser has been present for a long time considering the expansive demands in the everyday life. This invention is directed to solve these problems and satisfy the long-felt need.

SUMMARY OF THE INVENTION

The present invention contrives to solve the disadvantages of the prior art.

An object of the invention is to provide a cleaning device for cleaning dust off a condenser of a refrigerator.

Another object of the invention is to provide a cleaning device, which includes a cleaning brush traveling vertically.

Still another object of the invention is to provide a cleaning device, which the cleaning brush is configured to rotate.

An aspect of the invention provides a cooler cleaning device for condenser of a refrigerator.

The cooler cleaning device for a refrigerator having a compressor and a condenser (100), the cooler cleaning device comprising:

a guide frame (10) disposed on each side of the condenser (100), comprising a guide rail (11) along an inner side, a wing (12), an engaging portion (13);

a carrying plate (15) fixed to a delivering roll (14) through a hinge axis, engaging and commuting up and down along the guide rail (11) of the guide frame (10);

a driving motor (M) disposed on the carrying plate (15);

a wire winch (17) installed at a driving axle (16) of the driving motor (M); and a cleaning brush (18) connected to the wire winch (17) and configured to clean a surface of the condenser (100) by rotating driven by the driving motor (M), wherein a fixing panel (20) is fastened to the engaging portion (13) of the wing (12) of the guide frame (10), wherein a wire (22) penetrating top and bottom plates of the fixing panel (20) is fixed to an engaging clip (21) and the wire (22) is wound on the wire winch (17) fixed to the driving axle (16), such that as the wire winch (17) rotated by the driving motor (M) winds or unwinds the wire (22) the cleaning brush (18) commutes up and down.

In another embodiment of the cooler cleaning device, a pinion (30) is fixed to the driving axle (16) of the driving motor (M) disposed in the carrying plate (15) and a rack (31) is formed on an inner side of the fixing panel (20) disposed in the guide frame (10) so as to engage the pinion (30), such that the pinion (30) commutes up and down along the rack (31) by the rotation of the driving motor (M).

The cleaning brush (18) may be made of one selected from the group consisting of textile fabric or unwoven fabric.

Another aspect of the invention provides a cooler cleaning device for a refrigerator having a condenser.

The cooler cleaning device comprises:

a cylindrical cleaning portion comprising a driving axle and a cleaning surface disposed over a plurality of heat exchange fins of the condenser;

a wire winch installed at one end of the driving axle and configured to move the cylindrical cleaning portion through the driving axle up and down; and a driving motor engaged with the driving axle and configured to rotate the cylindrical cleaning portion around the driving axle.

The cleaning surface of the cylindrical cleaning portion contacts the plurality of heat exchange fins.

The cleaning surface is configured to clean dust stuck in the plurality of heat exchange fins by contacting with and rotating through the heat exchange fins.

Operational time and speed of the wire winch and the driving motor are controlled to optimize cleaning.

The cleaning surface of the cylindrical cleaning portion may be made of textile fabric. Alternatively, the cleaning surface of the cylindrical cleaning portion may be made of unwoven fabric. In certain embodiments of the invention, the cleaning surface of the cylindrical cleaning portion may be made of brush.

The stiffness and length of bristles of the brush may be determined to optimize cleaning dusts stuck in small crannies and nooks.

The cooler cleaning device may further comprise: a guide frame disposed on each side of the condenser, comprising a guide rail along an inner side, a wing, an engaging portion; and a carrying plate fixed to a delivering roll through a hinge axis, engaging and commuting up and down along the guide rail of the guide frame. A fixing panel may be fastened to the engaging portion of the wing of the guide frame. A wire penetrating top and bottom plates of the fixing panel may be fixed to an engaging clip and the wire may be wound on the wire winch fixed to the driving axle, such that, as the wire winch rotated by the driving motor winds or unwinds the wire, the cleaning brush commutes up and down.

In another embodiment of the invention, a pinion may be fixed to the driving axle of the driving motor disposed in the carrying plate and a rack may be formed on an inner side of the fixing panel disposed in the guide frame so as to engage the pinion, such that the pinion commutes up and down along the rack by the rotation of the driving motor.

The cleaning brush may be made of one selected from the group consisting of textile fabric or unwoven fabric.

The driving motor may be configured to rotate first and second rotating directions.

The driving motor may rotate in the first rotating direction while the wire winch moves the cylindrical cleaning portion downward, and the driving motor may rotate in the second rotating direction while the wire winch moves the cylindrical cleaning portion upward.

Still another aspect of the invention provides a cooler cleaning device for a refrigerator having a condenser.

In addition to the above inventive features, in certain embodiments of the invention, the cooler cleaning device further comprise a plurality of long brush portions.

The plurality of long brush portions are disposed on a plurality of selected locations of the cylindrical cleaning portion so as to protrude above the cleaning surface of the cylindrical cleaning portion and configured to reach and clean corners and nooks between the plurality of heat exchange fins of the condenser and to keep dust from being accumulated on the cylindrical cleaning portion.

The driving motor may be configured to rotate first and second rotating directions, where the second rotating direction is a reverse rotating direction of the first rotating direction. By these operations of the driving motor, the dust can be removed effectively and thus the efficiency of heat exchange of the condenser can be increased drastically.

Operation frequency and speed of the driving motor may be controlled according to density of dust where the refrigerator is operated so as to optimize the operation of the refrigerator.

The driving motor, the wire winch, and the cleaning brush may be provided integrally.

The cooler cleaning device may further comprise a stainless mesh provided in front of the condenser, and wherein the cleaning brush is configured to brush off the stainless mesh.

The driving motor, the wire winch, and the cylindrical cleaning portion may be provided integrally.

The driving motor can be a step motor, and the step motor may be configured to operated from a starting position to an ending position along a vertical direction of the condenser. The starting position and the ending position between which the step motor is controlled to operate, such that limit switch are not needed anymore.

The advantages of the present invention are: (1) the cleaning device can remove dust and other stuffs off the heat exchange fins of the condenser, facilitating the efficiency of the condenser and preventing the failure of compressor; (2) the cleaning brush can be formed with brush or textile or unwoven fabric, such that the brush contacts closely with the surface of the condenser; (3) the cleaning brush can remove small-sized dust from small holes nooks formed between the heat exchange fins of condenser.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Figure 1:
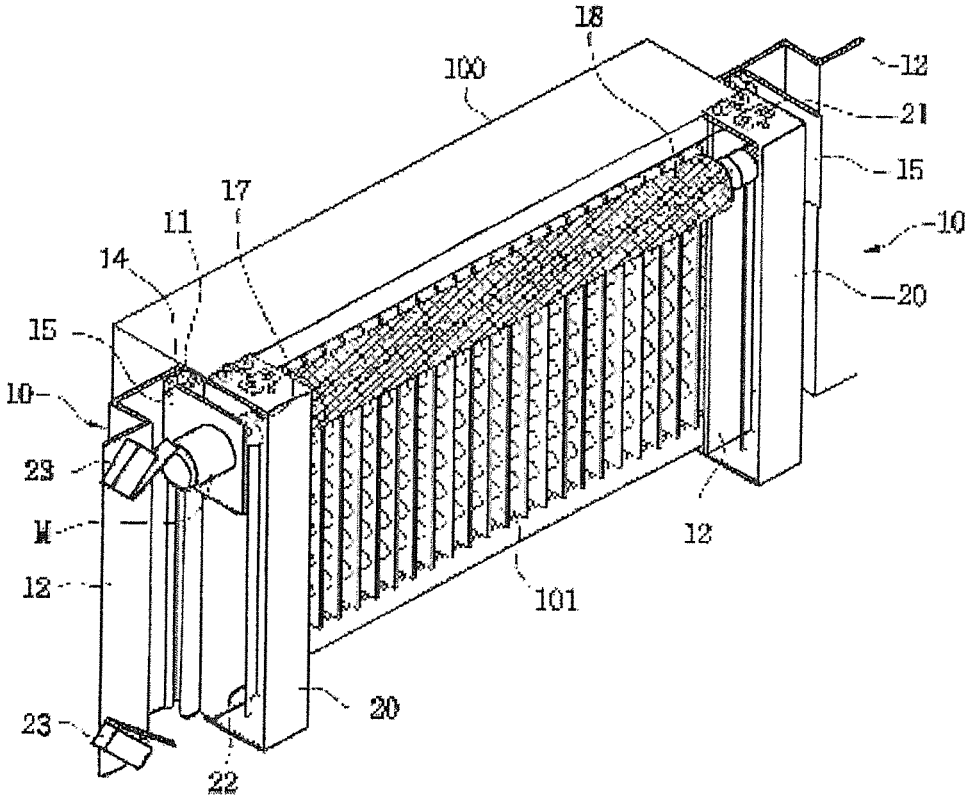
FIG. 1 is a perspective view showing how to use a cleaning device according to an embodiment of the invention.

FIGS. 1-4 show a cooler cleaning device according to embodiments of the present invention.

An aspect of the invention provides a cooler cleaning device for condenser of a refrigerator.

The cooler cleaning device for a refrigerator having a compressor and a condenser 100, the cooler cleaning device comprising:

a guide frame 10 disposed on each side of the condenser 100, comprising a guide rail 11 along an inner side, a wing 12, an engaging portion 13;

a carrying plate 15 fixed to a delivering roll 14 through a hinge axis, engaging and commuting up and down along the guide rail 11 of the guide frame 10;

a driving motor M disposed on the carrying plate 15;

a wire winch 17 installed at a driving axle 16 of the driving motor M; and a cleaning brush 18 connected to the wire winch 17 and configured to clean a surface of the condenser 100 by rotating driven by the driving motor M, wherein a fixing panel 20 is fastened to the engaging portion 13 of the wing 12 of the guide frame 10, wherein a wire 22 penetrating top and bottom plates of the fixing panel 20 is fixed to an engaging clip 21 and the wire 22 is wound on the wire winch 17 fixed to the driving axle 16, such that as the wire winch 17 rotated by the driving motor M winds or unwinds the wire 22 the cleaning brush 18 commutes up and down.

In another embodiment of the cooler cleaning device, a pinion 30 is fixed to the driving axle 16 of the driving motor M disposed in the carrying plate 15 and a rack 31 is formed on an inner side of the fixing panel 20 disposed in the guide frame 10 so as to engage the pinion 30, such that the pinion 30 commutes up and down along the rack 31 by the rotation of the driving motor M.

The cleaning brush 18 may be made of one selected from the group consisting of textile fabric or unwoven fabric.

Another aspect of the invention provides a cooler cleaning device for a refrigerator having a condenser 100.

The cooler cleaning device comprises:

a cylindrical cleaning portion 18 comprising a driving axle 16 and a cleaning surface disposed over a plurality of heat exchange fins 101 of the condenser 100;

a wire winch 17 installed at one end of the driving axle 16 and configured to move the cylindrical cleaning portion 18 through the driving axle 16 up and down; and a driving motor M engaged with the driving axle 16 and configured to rotate the cylindrical cleaning portion 18 around the driving axle 16.

The cleaning surface of the cylindrical cleaning portion 18 contacts the plurality of heat exchange fins 101.

The cleaning surface is configured to clean dust stuck in the plurality of heat exchange fins 101 by contacting with and rotating through the heat exchange fins 101.

Operational time and speed of the wire winch 17 and the driving motor M are controlled to optimize cleaning.

The cleaning surface of the cylindrical cleaning portion 18 may be made of textile fabric. Alternatively, the cleaning surface of the cylindrical cleaning portion 18 may be made of unwoven fabric. In certain embodiments of the invention, the cleaning surface of the cylindrical cleaning portion 18 may be made of brush.

The stiffness and length of bristles of the brush may be determined to optimize cleaning dusts stuck in small crannies and nooks of the heat exchange fins 101.

The cooler cleaning device may further comprise: a guide frame 10 disposed on each side of the condenser 100, comprising a guide rail 11 along an inner side, a wing 12, an engaging portion 13; and a carrying plate 15 fixed to a delivering roll 14 through a hinge axis, engaging and commuting up and down along the guide rail 11 of the guide frame 10. A fixing panel 20 may be fastened to the engaging portion 13 of the wing 12 of the guide frame 10. A wire 22 penetrating top and bottom plates of the fixing panel 20 may be fixed to an engaging clip 21 and the wire 22 may be wound on the wire winch 17 fixed to the driving axle 16, such that, as the wire winch 17 rotated by the driving motor M winds or unwinds the wire 22, the cleaning brush commutes up and down.

In another embodiment of the invention, a pinion 30 may be fixed to the driving axle 16 of the driving motor M disposed in the carrying plate 15 and a rack 31 may be formed on an inner side of the fixing panel 20 disposed in the guide frame 10 so as to engage the pinion 30, such that the pinion 30 commutes up and down along the rack 31 by the rotation of the driving motor M.

The cleaning brush may be made of one selected from the group consisting of textile fabric or unwoven fabric.

The driving motor M may be configured to rotate first and second rotating directions.

The driving motor M may rotate in the first rotating direction while the wire winch 17 moves the cylindrical cleaning portion 18 downward, and the driving motor M may rotate in the second rotating direction while the wire winch 17 moves the cylindrical cleaning portion 18 upward.

Figure 2:
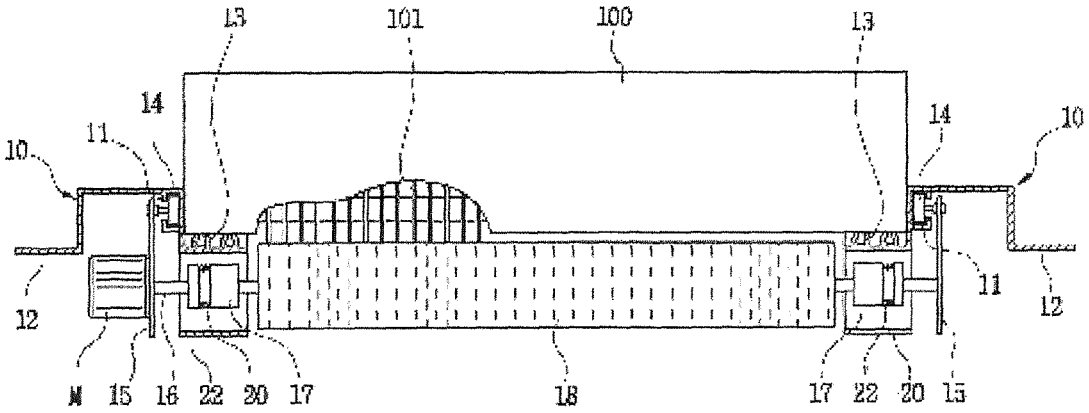
FIG. 2 is a cross-sectional plan view showing driving means according to an embodiment of the present invention.
Figure 3:
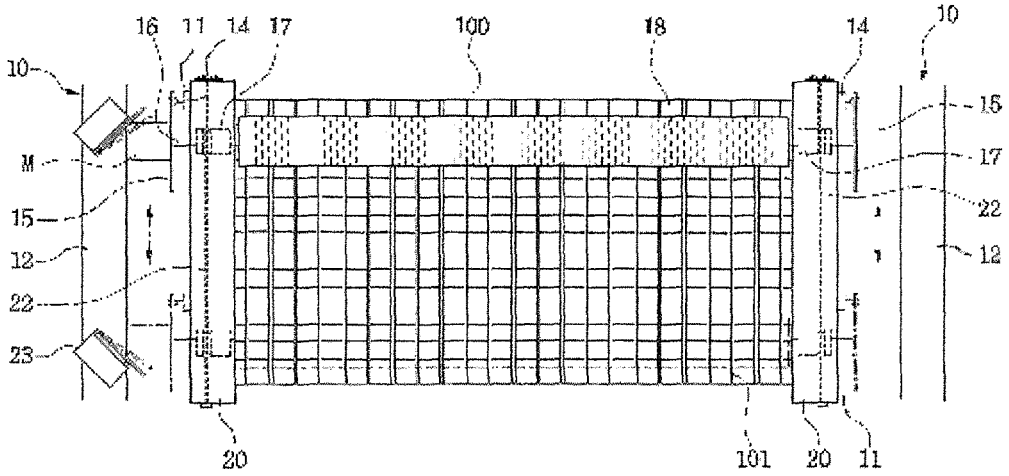
FIG. 3 is a front plan view showing how to use a cleaning device according to an embodiment of the present invention.
Figure 4:
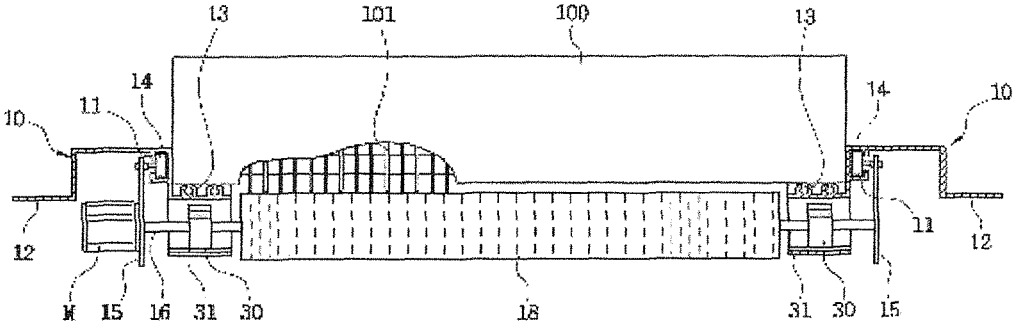
FIG. 4 is a cross-section view showing a cleaning device according to another embodiment of the present invention.

FIG. 1 is a perspective view showing how to use a cleaning device according to an embodiment of the invention, FIG. 2 a cross-sectional plan view showing driving means according to an embodiment of the present invention, FIG. 3 a front plan view showing how to use a cleaning device according to an embodiment of the present invention, and FIG. 4 is a cross-section view showing a cleaning device according to another embodiment of the present invention.

Another aspect of the invention is to clean dust and debris collected at the condenser 100 from air blown by a ventilating fan, in which the condenser 100 and the compressor circulate refrigerant in the showcase, freezer, or refrigerator.

To both side of the condenser 100 are fastened guide frames 10 using bolts etc., each of which has a shape of squarely raised single bump (refer to FIG. 104) and includes a guide rail 11 at an inner side and engaging portion 13 to the outside of a wing 12, a pair of delivering rolls 14, which move up and down, are guided by the guide rails 11 formed inside the guide frame 10, and a carrying plate 15 penetrates a hinge axis of the delivering roll 14 and fixed by nuts at the front and rear sides such that the delivering roll 14 moves the delivering plate 15 up and down along the guide rail 11, a driving axle 16 of a driving motor M installed at one of the two delivering plates 15 penetrates the delivering plates 15 penetrates the delivering plates 15, at which are installed a wire winch 17 and a cleaning brush 18, such that one end of the cleaning brush 18 is hinge-connected to the delivering plate 15 at the other side and rotated by the power of the driving motor M, two fixing panels 20, each having a cross-sectional shape of bracket, engage the engaging portions 13 of the wings 12 of the guide frame 10 at the top and bottom sides, a wire 22 fixed by engaging clip 21 through the top and bottom plates of the fixing panels 20 is wound at the wire winch 17 one or more times fixed to the driving axle 16 disposed inside of the fixing panel 20, and the wire winch 17 powered by the driving motor M winds or unwinds the wire 22 moving the cleaning brush 18 up and down.

The cleaning brush 18 may be pushed toward the condenser 100 so as to clean dust and other debris off the heat exchange fins 101 of the condenser 100, or may be configured to be received into between the heat exchange fins 101 by a predetermined depth, and the cleaning brush 18 may be made of brush or unwoven fabric.

Also, the wire winch 17 may be provided with wire grooves or coated with slip-preventing resin material.

And, a limit switch 23 may be installed on the guide frame 10 at an upper and/or lower positions of the cleaning brush 18 or the driving motor M for controlling the range of operation of the driving motor M.

According to another embodiment of the invention in FIG. 4, a pinion 30 is fixed to the driving axle 16 of the driving motor M guided to the guide rail 11 of the guide frame 10 fixed to the both sides of the condenser 100 by bolts and engaged to the delivering plate 15 moving up and down, and a rack 31 is formed to the inside of the fixing panel 20 engaged to the guide frame 10 so as to engage the pinion 30, such that the pinion 30 rotated by the driving motor M reciprocates up and down along the rack 31.

The rack 31 may be formed at one of the inside of the fixing panel 20 or the wing surface of the guide frame 10.

Therefore, the driving axle 16 rotated by power is moved up and down while rotating the cleaning brush 18.

In the description and the drawings of the present invention, power-supplying lines for the limit switch 30 and the driving motor M are omitted.

The operation states for embodying the present invention is going to be described referring to the figures.

As shown in the perspective view of FIG. 1, the cross-sectional plan view of FIG. 2, and the perspective front view of FIG. 3, the present invention is to provide an apparatus, which cleans dust and debris off the condenser 100 for the showcase, freezers, or refrigerator, in which air blown from a ventilating fan to the condenser 100 for heat exchange in a process of refrigerant compressing has dust and debris stuck in the heat exchange 101 of the condenser 100, reducing the efficiency of heat exchange, which must be removed periodically.

This cleaning can be done periodically manually or by a controlling device (not shown), and the driving motor M is operated by supplying power according to the control. Therefore, the wire winch 17 and the cleaning brush 18 fixed to the driving axle 16 are made to rotate by the rotation of the driving axle 16.

Such a rotation winds the wire 22 wound at the wire winch 17 in a direction of rotation, for example, the top portion of the wire 22 and unwinds the other side, such that an upward-force is formed in the wire winch 17, and the entire driving axle 16, the delivering plate 15 penetrating the driving axle 16, and the driving motor M fixed to the delivering plate 15 move upward, and the delivering roll 14 engaging the delivering plate 15 is guided by the guide rail 11 formed in the guide frame 10, so as to move up and down precisely.

The cleaning brush 18 rotated by the rotating driving axle 16 moves upward while rotating, and slip-rotates against the condenser 100 and the heat exchange fins 101 stuck with dust and debris from the air from the ventilating fan, so as to clean them off.

When reaching the top limit point performing the above jobs, the cleaning brush 18 touches the limit switch 23 formed in the wing 12 of the guide frame 10, and then the limit switch 23 controls the electrical power and reverses the rotation of the cleaning brush 18, from one direction to the other direction.

Such a reverse rotation is applied to the driving motor M and the driving axle 16 together, winding the bottom portion of wire 22 and unwinding the top portion of wire 22 at the wire winch 17, such that the wire winch 17 moves downward, and if reaching the bottom limit point and touching the limit switch 23 then the rotation direction of the driving motor M is changed.

The cleaning brush 18 that is operated by the up-down movement by reciprocation and the rotation by the driving axle 16 removes the dust and debris stuck in the heat exchange fins 101 of the cooler continuously, and increases the efficiency of heat exchange of the cooler due to the thorough cleaning and repeated cleaning.

In another embodiment of the invention as shown in FIG. 4, the delivering plate 15 is guided by the guide rail 11 of the guide frame 10 fastened to both sides of the condenser 100 and reciprocates, the driving motor M is fixed to the delivering plate 15 and the pinion 30 is fixed to the driving axle 16, and the rack 31 is formed inside the fixing panel 20 engaging the guide frame 10 so as to engage the pinion 30.

Therefore, the pinion 30 that is rotated by the rotation of the driving motor M reciprocates along the rack 31 and the cleaning brush 18 installed in the driving axle 16 which moves by such a rotation rotates so as to clean the dust and debris off the condenser 100 and the heat exchange fins 101 through such up-down movement and rotation.

The cleaning brush 18 that rotates and reciprocates according to the invention cleans the dust and debris collected at the condenser 100 and the heat exchange fins 101 from the air blown by the ventilating fan in a compressing process of refrigerant circulating through the compressor and the condenser 100.

The cleaning brush 18 may be made in a form of brush or in a form of pad of unwoven fabric. And, the device may further comprise a controller for providing a function of automatic cleaning at predetermined time and date or the cleaning may be started manually.

Figure 5:
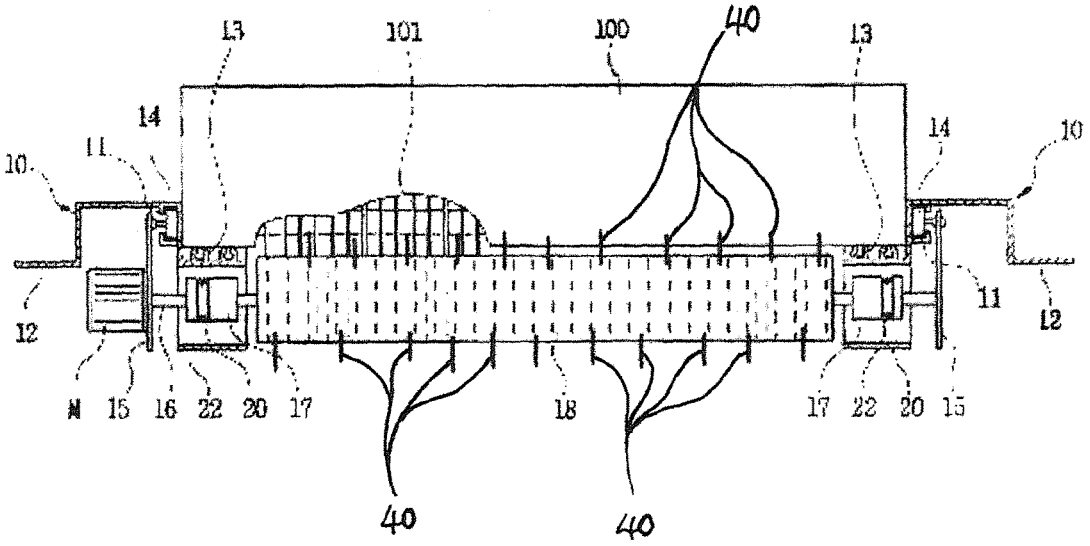
FIG. 5 is a top view showing a cleaning device having long brush portions according to still another embodiment of the present invention.
Figure 6:
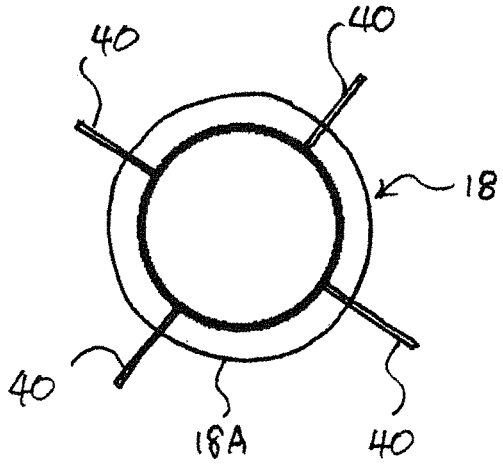
FIG. 6 is a cross-sectional view of a cleaning brush and long brush portions of FIG. 5.

In addition to the above inventive features, in certain embodiments of the invention, the cooler cleaning device further comprise a plurality of long brush portions 40 as shown in FIGS. 5 and 6.

The plurality of long brush portions 40 are disposed pretty much evenly all over the cleaning surface 18A of the cylindrical cleaning portion or cleaning brush 18. Usually, they are provided with pretty less density than the cleaning brush 18. In certain embodiments of the invention, the length of each of the plurality of long brush portion 40 may have some variation across the cleaning surface 18 of the cleaning brush 18, but still longer than any strands of the cleaning brush 18, of course.

Still in certain embodiments of the invention, each of the plurality of long brush portion 40 may be realized by a single strand of or by a couple of strands of stiff but still flexible pin-type material.

The plurality of long brush portions 40 are disposed on a plurality of selected locations of the cylindrical cleaning portion 18 so as to protrude above the cleaning surface 18A of the cylindrical cleaning portion 18 as shown in FIG. 6 and configured to reach and clean corners and nooks between the plurality of heat exchange fins of the condenser 100 and to keep dust from being accumulated on the cylindrical cleaning portion 18.

The driving motor M may be configured to rotate first and second rotating directions, where the second rotating direction is a reverse rotating direction of the first rotating direction. By these operations of the driving motor M, the dust can be removed effectively and thus the efficiency of heat exchange of the condenser 100 can be increased drastically. By adopting reversed rotational directions, the cleaning brush 18 may reach the dust much more thoroughly, facilitating the cleaning.

Operation frequency and speed of the driving motor M may be controlled according to density of dust where the refrigerator is operated so as to optimize the operation.

The driving motor M, the wire winch 17, and the cleaning brush 18 are provided integrally as shown in FIG. 5. The three components are provided in a single structure aligned horizontally and move along a wire and over the condenser 100 together, too. This type of structure according to the invention is more efficient and provides a less resistance against the movement and enables reducing of weight of the driving motor M rather than the type using gear as in prior arts.

Figure 7:
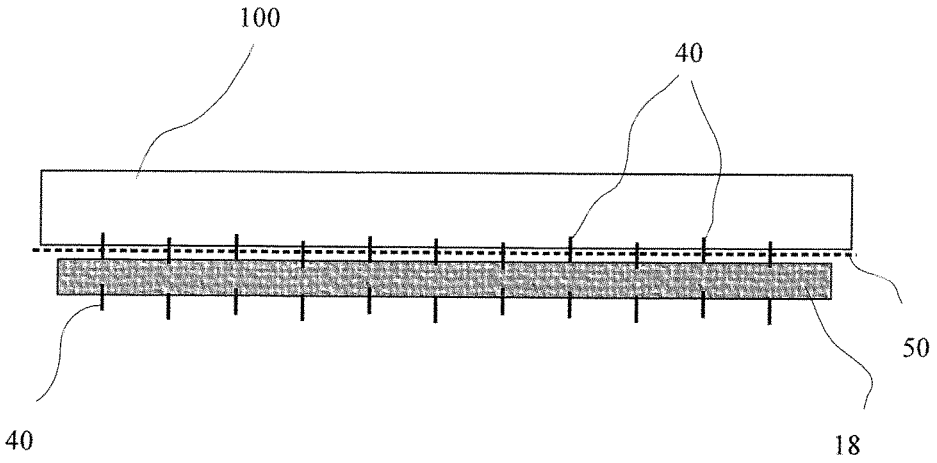
FIG. 7 is a top plan view of a cleaning device having a stainless mesh to still another embodiment of the present invention.

The cooler cleaning device may further comprise a stainless mesh 50 provided in front of the condenser 100, and wherein the cleaning brush 18 is configured to brush off the stainless mesh 50 as shown in FIG. 7.

The driving motor M, the wire winch 17, and the cylindrical cleaning portion 18 may be provided integrally.

Figure 8:
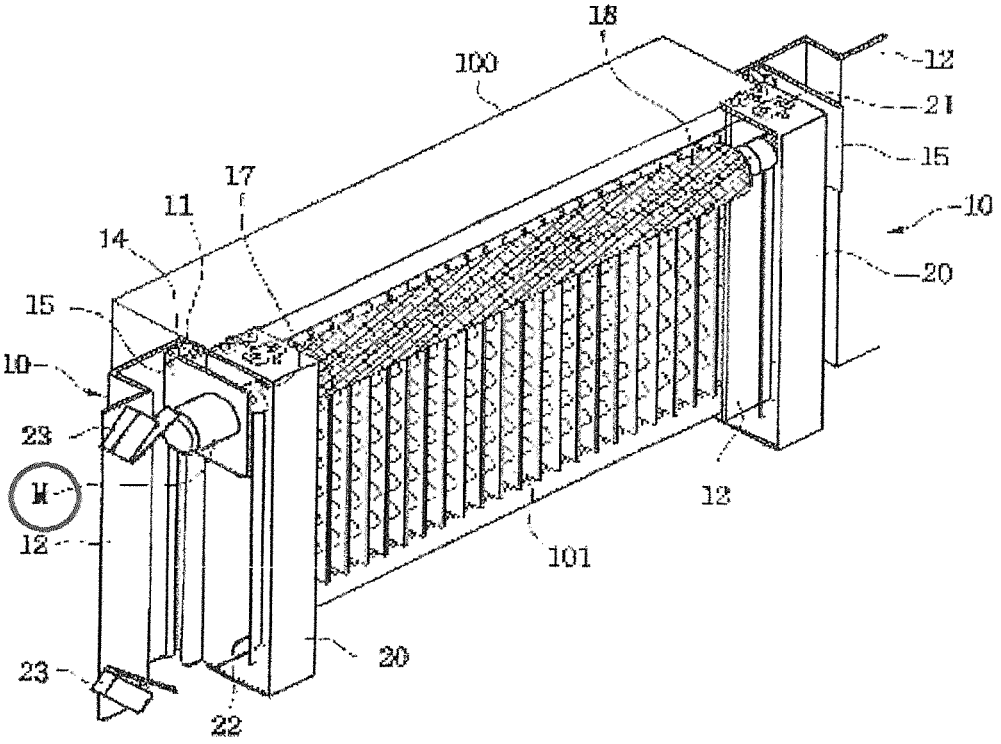
FIG. 8 is a perspective view showing a cleaning device having a step motor to still another embodiment of the present invention.

The driving motor M can be a step motor, and the step motor may be configured to operated from a starting position to an ending position along a vertical direction of the condenser 100 as shown in FIG. 8. The starting position and the ending position between which the step motor is controlled to operate, such that limit switch 23 are not needed anymore. For the purpose, a controller (not shown) can be provided separately to control the vertical segments of the condenser 100 or the stainless mesh 50 over which the step motor 50 operates.

In certain embodiments of the invention, the cooler cleaning device may further comprising a dust scraper 60 disposed over the cylindrical cleaning portion.

FIGS. 9 to 12 show the dust scraper 60 according to still another embodiment of the invention.

Figure 9:
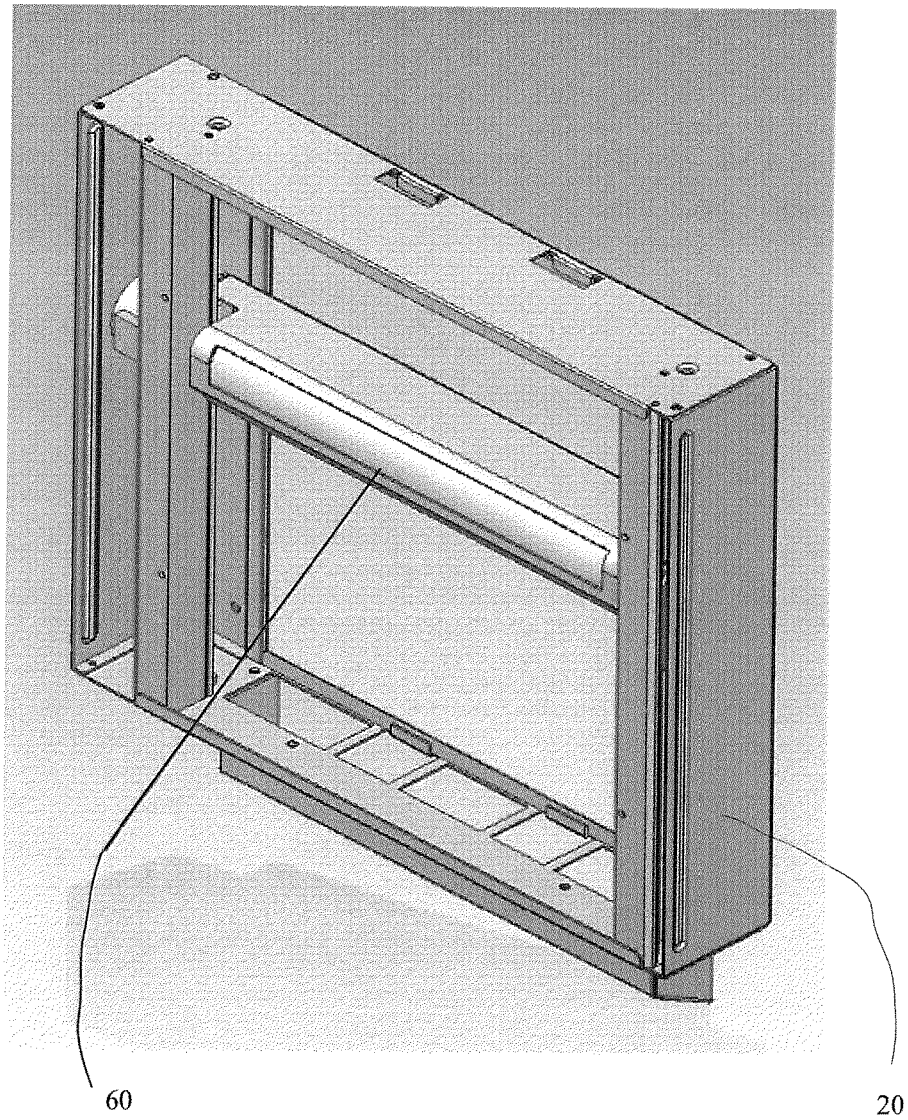
FIG. 9 is a perspective view showing a cleaning brush, a wire winch, and a fixing frame along with a dust scraper according to still another embodiment of the present invention.
Figure 10:
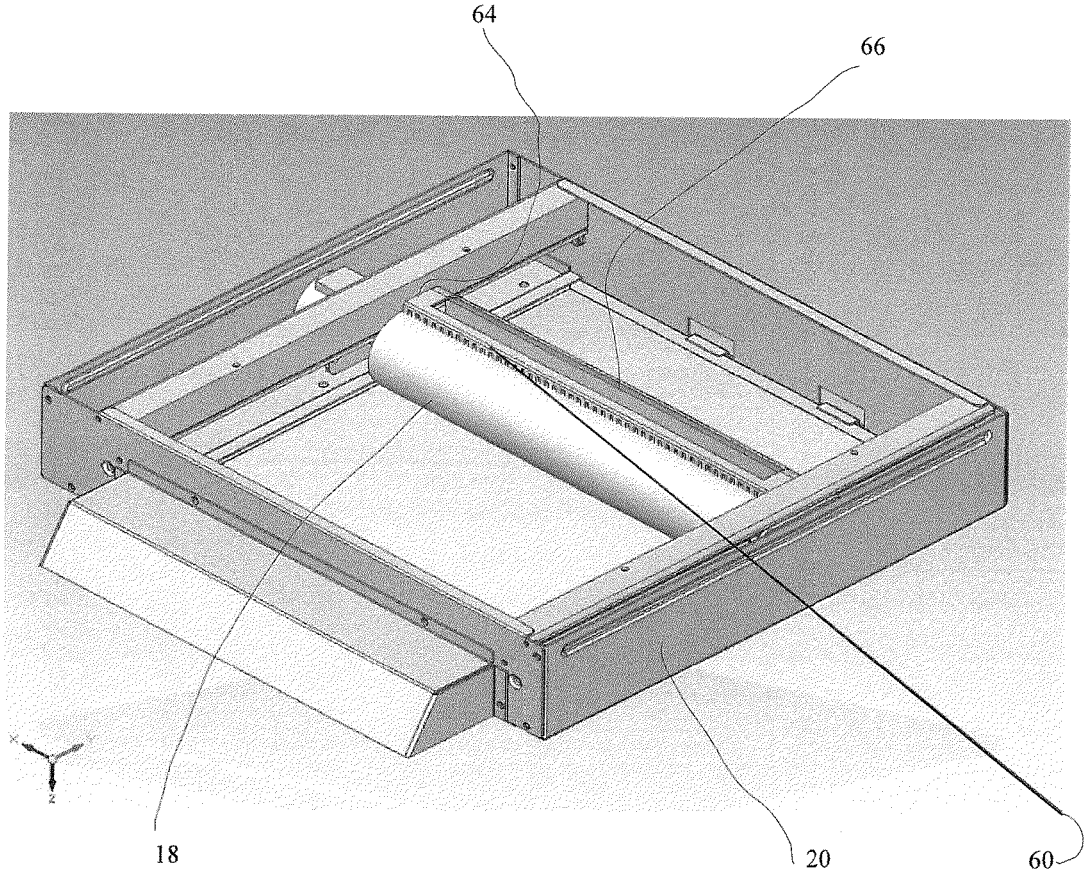
FIG. 10 is another perspective view showing FIG. 9 in a different angle.
Figure 11:
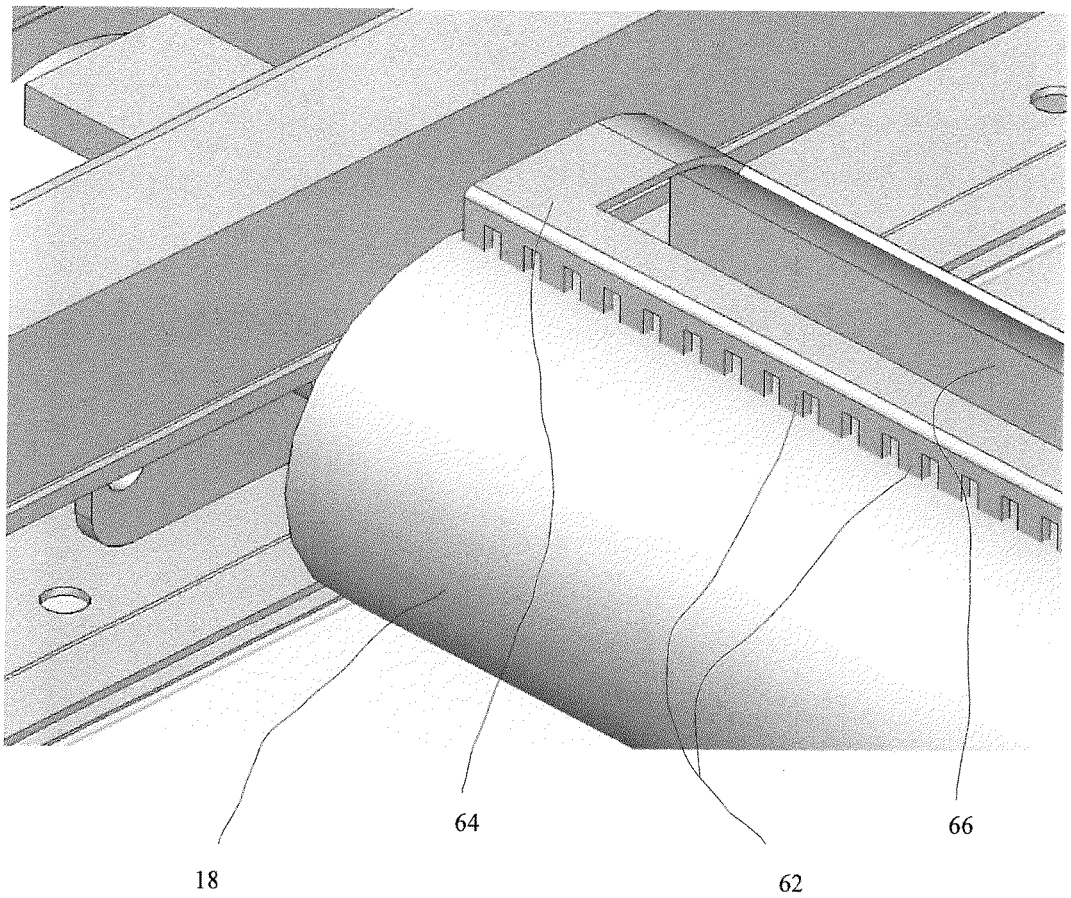
FIG. 11 is a blow-up partial perspective view showing the dust scraper and the cleaning brush of FIG. 9.
Figure 12:
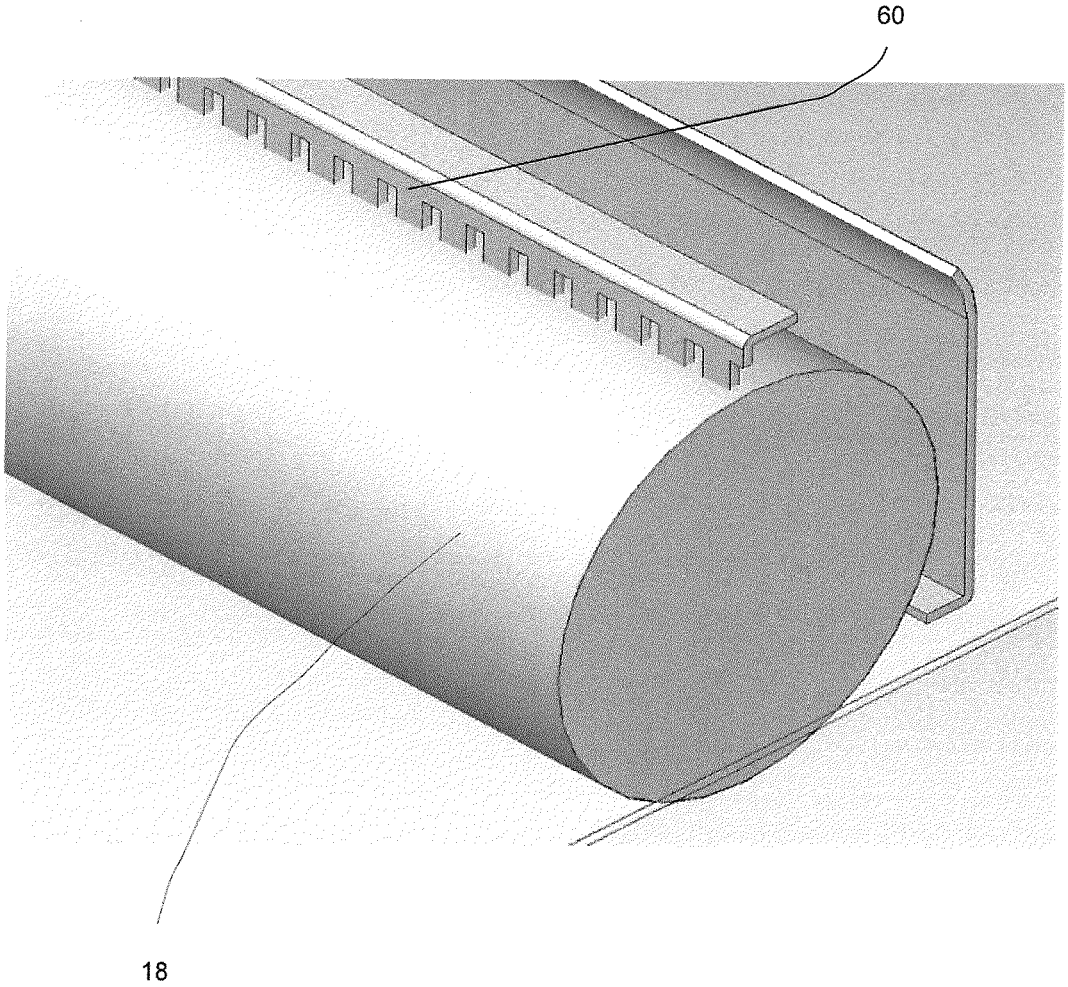
FIG. 12 is another blow-up partial perspective view showing the dust scraper and the cleaning brush of FIG. 9.

FIGS. 9 and 10 show perspective views of the cleaning brush 18, the wire winch 17, and the fixing frame 20 along with the dust scraper 60, and FIGS. 11 and 12 show blow-up partial perspective views of the dust scraper 60 and the cleaning brush 18 of FIG. 9.

The dust scraper 60 may comprise a plurality of prongs 62 like a comb, and be configured for scraping off dust from the cleaning surface of the cylindrical cleaning portion 18 and the plurality of long brush portions 40.

As shown in the illustrated embodiment, the dust scraper 60 may further comprise a cover 64, a maintaining window 66.

The cleaning brush 18 rotates, collects dust from the condenser fins or the stainless mesh, and the dust collected thereon is scraped off at the plurality of prongs 62.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A cooler cleaning device for a refrigerator having a condenser, the cooler cleaning device comprising: a cylindrical cleaning portion comprising a driving axle and a cleaning surface disposed over a plurality of heat exchange fins of the condenser; a plurality of long brush portions disposed on a plurality of selected locations of the cylindrical cleaning portion so as to protrude above the cleaning surface of the cylindrical cleaning portion and configured to reach and clean corners and nooks between the plurality of heat exchange fins of the condenser and to keep dust from being accumulated on the cylindrical cleaning portion; a wire winch installed at one end of the driving axle and configured to move the cylindrical cleaning portion through the driving axle up and down; and a driving motor engaged with the driving axle and configured to rotate the cylindrical cleaning portion around the driving axle, wherein the cleaning surface of the cylindrical cleaning portion contacts the plurality of heat exchange fins, wherein the cleaning surface is configured to clean dust stuck in the plurality of heat exchange fins by contacting with and rotating through the heat exchange fins, and wherein operational time and speed of the wire winch and the driving motor are controlled to optimize cleaning, a guide frame disposed on each side of the condenser, comprising a guide rail along an inner side, a wing, an engaging portion; and a carrying plate fixed to a delivering roll through a hinge axis, engaging and commuting up and down along the guide rail of the guide frame, wherein a fixing panel is fastened to the engaging portion of the wing of the guide frame, wherein a wire penetrating top and bottom plates of the fixing panel is fixed to an engaging clip and the wire is wound on the wire winch fixed to the driving axle, such that, as the wire winch rotated by the driving motor winds or unwinds the wire, the cleaning brush commutes up and down.

2. The cooler cleaning device of claim 1, wherein the cleaning surface of the cylindrical cleaning portion is made of textile fabric, unwoven, or brush.

3. The cooler cleaning device of claim 2, wherein stiffness and length of bristles of the brush is determined to optimize cleaning dusts stuck in small crannies and nooks.

4. The cooler cleaning device of claim 1, wherein a pinion is fixed to the driving axle of the driving motor disposed in the carrying plate and a rack is formed on an inner side of the fixing panel disposed in the guide frame so as to engage the pinion, such that the pinion commutes up and down along the rack by the rotation of the driving motor.

5. The cooler cleaning device of claim 4, wherein the cleaning brush is made of one selected from the group consisting of textile fabric or unwoven fabric.

6. The cooler cleaning device of claim 1, wherein the driving motor is configured to rotate first and second rotating directions, wherein the second rotating direction is a reverse rotating direction of the first rotating direction.

7. The cooler cleaning device of claim 6, wherein the driving motor rotates in the first rotating direction while the wire winch moves the cylindrical cleaning portion downward, and the driving motor rotates in the second rotating direction while the wire winch moves the cylindrical cleaning portion upward.

8. The cooler cleaning device of claim 1, wherein operation frequency and speed of the driving motor are controlled according to density of dust where the refrigerator is operated so as to optimize the operation of the refrigerator.

9. A cooler cleaning device for a refrigerator having a compressor and a condenser (100), the cooler cleaning device comprising:

a guide frame (10) disposed on each side of the condenser (100), comprising a guide rail (11) along an inner side, a wing (12), an engaging portion (13);

a carrying plate (15) fixed to a delivering roll (14) through a hinge axis, engaging and commuting up and down along the guide rail (11) of the guide frame (10);

a driving motor (M) disposed on the carrying plate (15);

a wire winch (17) installed at a driving axle (16) of the driving motor (M);

a cleaning brush (18) connected to the wire winch (17) and configured to clean a surface of the condenser (100) by rotating driven by the driving motor (M); and a plurality of long brush portions (40) disposed on a plurality of selected locations of the cleaning brush (18) so as to protrude above a cleaning surface (18A) of the cleaning brush (18) and configured to reach and clean corners and nooks between a plurality of heat exchange fins of the condenser (100) and to keep dust from being accumulated on the cleaning brush (18), wherein a fixing panel (20) is fastened to the engaging portion (13) of the wing (12) of the guide frame (10), wherein a wire (22) penetrating top and bottom plates of the fixing panel (20) is fixed to an engaging clip (21) and the wire (22) is wound on the wire winch (17) fixed to the driving axle (16), such that, as the wire winch (17) rotated by the driving motor (M) winds or unwinds the wire (22), the cleaning brush (18) commutes up and down, further comprising a stainless mesh (50) provided in front of the condenser (100), and wherein the cleaning brush (18) is configured to brush off the stainless mesh, further comprising a dust scraper (60) disposed over the cylindrical cleaning portion, comprising a plurality of prongs (62), and configured for scraping off dust from the cleaning surface of the cylindrical cleaning portion and the plurality of long brush portions.

10. The cooler cleaning device of claim 9, wherein a pinion (30) is fixed to the driving axle (16) of the driving motor (M) disposed in the carrying plate (15) and a rack (31) is formed on an inner side of the fixing panel (20) disposed in the guide frame (10) so as to engage the pinion (30), such that the pinion (30) commutes up and down along the rack (31) by the rotation of the driving motor (M).

11. The cooler cleaning device of claim 9, wherein the cleaning brush (18) is made of one selected from the group consisting of textile fabric or unwoven fabric.

12. The cooler cleaning device of claim 9, wherein the driving motor (M) is configured to rotate first and second rotating directions, wherein the second rotating direction is a reverse rotating direction of the first rotating direction.

13. The cooler cleaning device of claim 11, wherein the driving motor (M) rotates in the first rotating direction while the wire winch (17) moves the cleaning brush (18) downward, and the driving motor (M) rotates in the second rotating direction while the wire winch (17) moves the cleaning brush (18) upward.

14. The cooler cleaning device of claim 9, wherein operation frequency and speed of the driving motor (M) are controlled according to density of dust where the refrigerator is operated so as to optimize the operation of the refrigerator.

* * * * *